US005722509A

United States Patent [19]

Clinger

[11] Patent Number: 5,722,509

[45] Date of Patent: Mar. 3, 1998

[54] FLANGE OILER

[75] Inventor: Daniel Clifton Clinger, Haw Thorn, Pa.

[73] Assignee: Consolidated Rail Corporation, Philadelphia, Pa.

[21] Appl. No.: 648,353

[22] Filed: May 14, 1996

[51] Int. Cl.[6] ..... B61K 3/00; E01B 9/62

[52] U.S. Cl. ..... 184/3.1; 238/349; 238/351; 248/74.2; 248/74.5; 138/106; 24/336; 24/346; 24/563

[58] Field of Search ..... 184/2, 3.1, 3.2, 184/6.28, 109; 238/310, 338, 349, 351; 248/74.1, 74.2, 74.5; 174/40 CC, 40 TD, 135; 285/8, 240–241, 253; 138/106; 411/174–175; 24/336, 346, 563

[56] References Cited

U.S. PATENT DOCUMENTS

| | | | |
|---|---|---|---|
| 1,839,427 | 1/1932 | Warr . | |
| 1,883,148 | 10/1932 | Warr . | |
| 1,896,702 | 2/1933 | Davis | 184/3.1 |
| 1,940,527 | 12/1933 | Bolt . | |
| 1,977,755 | 10/1934 | Dudley . | |
| 2,016,975 | 10/1935 | Stern . | |
| 2,016,976 | 10/1935 | Stern . | |
| 2,098,791 | 11/1937 | Perazzoli . | |
| 2,103,701 | 12/1937 | Stern . | |
| 2,168,577 | 8/1939 | Overmier et al. . | |
| 2,643,738 | 6/1953 | Magnus . | |
| 2,884,093 | 4/1959 | Stewart . | |
| 2,929,466 | 3/1960 | Mcwilliams . | |
| 2,995,209 | 8/1961 | Magnus . | |
| 2,995,210 | 8/1961 | Stemberger . | |
| 3,051,262 | 8/1962 | Bettison . | |
| 3,059,724 | 10/1962 | Soule, Jr. . | |
| 3,147,822 | 9/1964 | Watts . | |
| 3,163,257 | 12/1964 | McWilliams . | |
| 4,214,647 | 7/1980 | Lutts . | |
| 4,245,719 | 1/1981 | Frank . | |
| 4,334,596 | 6/1982 | Lounsberry, Jr. . | |
| 4,346,785 | 8/1982 | Frank . | |
| 4,489,809 | 12/1984 | Wade . | |
| 4,520,901 | 6/1985 | Borup et al. . | |
| 4,556,127 | 12/1985 | Doorley et al. . | |
| 4,834,218 | 5/1989 | Dombroski et al. . | |
| 4,856,617 | 8/1989 | Lounsberry, III et al. . | |
| 5,076,396 | 12/1991 | Foote . | |
| 5,127,577 | 7/1992 | Lynch, Jr. et al. | 238/351 |
| 5,148,981 | 9/1992 | Lynch, Jr. et al. . | |
| 5,192,040 | 3/1993 | Washizu | 248/74.5 |
| 5,348,120 | 9/1994 | Junk et al. . | |

FOREIGN PATENT DOCUMENTS

| | | | |
|---|---|---|---|
| 0327942 | 10/1920 | Germany | 285/253 |

*Primary Examiner*—Christopher Verdier
*Attorney, Agent, or Firm*—Woodcock Washburn Kurtz Mackiewicz & Norris LLP

[57] ABSTRACT

A tube and tube retainer applied to the base of a railroad rail and capable of being simply and quickly adjusted for the application of lubricant to the wheel/rail interface contact patch. The tube accepts a lubricant supply from an external source at one end and directs it to the appropriate area of the wheel/rail contact patch. Implementation may include a plurality of such tubes on one or both rails to improve effectiveness. The present invention reduces overall waste by applying smaller amounts of lubricant with each tube, but increasing the total amount of lubricant applied.

14 Claims, 3 Drawing Sheets

FLANGE OILER

The present invention is directed to methods and apparatus for continuously applying lubricant, and more particularly, to lubrication systems employing a tube for application of lubricant to the area of flange contact between a wheel and the rail.

BACKGROUND OF THE INVENTION

Prior art devices are known that apply a lubricant to the wheel/rail interface from the track wayside, and are commonly called "flange oilers." Typically, flange oilers are provided near curves or other sections of track where the metal-to-metal contact forces between the wheel and the rail increase dramatically. By providing lubrication, wear phenomena such as spalling are prevented and the life of the railcar wheels is generally improved, as is the life of the track. Rolling friction is also lessened, thereby increasing fuel efficiency. There are therefore a number of benefits to providing flange oilers.

Numerous types of these wayside wheel/rail lubricators have been proposed and/or are in use. Two particular types of flange oilers are well known. The first is illustrated in FIG. 6, and is a manifold 50 that is between 9–18 inches long that is affixed to a section of rail. The mounting of the oiler may require a section 52 of the gauge face of the rail that is as long as the manifold be ground away. The device is connected to a pump (not illustrated) that forces lubricant to the top surface of the manifold, providing a film that is picked up by the railcar wheel. A second type of device, not illustrated, is a plunger or hydraulic cylinder that is placed adjacent the track. When the train rolls over the end of the plunger, power is supplied to the lubrication system.

Other designs are also known. For example, U.S. Pat. No. 2,098,791—Perazzoli which discloses a rail lubricator that uses a bent piece of tubing inserted into a small hole drilled in the rail. U.S. Pat. No. 3,059,724—Soule, Jr. discloses a tubing system for applying oil to the top of the rail, but discloses that the lubricant should be sprayed in an arc over the top of the rail. U.S. Pat. No. 4,334,596—Lounsberry, Jr. also discloses a flange oiler that uses a tubing system. Finally, U.S. Pat. No. 4,346,785—Frank discloses a flange oiler that uses a tubing system terminated by a complex nozzle arrangement that is bolted to the sides of the rail.

However, all of these prior art implementations suffer from a number of problems. First, they are not necessarily interchangeable from rail section to rail section and use a complex assembly of parts, thereby requiring complicated tools and gauges to perform adjustments. The prior art systems also usually require expensive disassembly or change out of the entire applicator assembly if the applicator is damaged. Second, because of wear of the rail head section in curves, the prior art systems are very difficult, if not impossible to install and maintain on curved railroad track. Additionally, the prior art devices make precise application of lubricant at the contact patch corner of the rail impossible without extensive in-situ modification of the existing rail section and also interfere with application of effective contamination containment devices located between the rails, such as absorbent pads or troughs. A related problem is that the prior art systems are prone to plugging with traction sand and require removal from the rail and complete disassembly for proper cleaning. Finally, the prior art systems typically attach the lubricating device using fasteners that are prone to loosening in the high vibration rail environment.

SUMMARY OF THE INVENTION

It has now been found that the shortcomings of the prior art can be overcome by a system that provides a malleable tube capable of receiving a lubricant under pressure at its lower end and discharging the lubricant at its upper end at the precise location of the contact patch of the wheel/rail interface. The tube is most preferably affixed to the rail with a spring tube retainer that is easily driven onto the rail base, and that has barbs to hold it securely onto the rail without damage to the rail base. The tube is preferably manufactured of material that is both suitable for being moved or adjusted by hand and, at the same time, strong enough to withstand the lubricant pressures. The tube is shaped to keep clear of the area where it is likely to be damaged by passing train wheels or dragging materials. The tube shape also allows easy adjustment by bending the tube by hand, without the use of tools. A tube assembly can thus be used with any size rail section. This permits the flange oiler of the present invention to be located in curved railroad track, unlike prior art.

In one preferred embodiment, the upper section of the tube is flattened to form a dispensing tip and to protect it from contact with the passing wheels. On worn rail sections, the rail head can be relieved in the vicinity of the tube with a die grinder to enhance this protection. Additionally, damage to the dispensing tip can be repaired by inserting a slim tool such as a screwdriver into the dispensing tip of the tube to restore its opening to the proper size. As the dispensing tip wears, it can be bent easily by hand to restore its height. These features represent a significant decrease in the time and the cost required for applicator maintenance.

The present invention thus provides a device preferably formed from soft copper tubing, about ¼ inch diameter, which is bent and formed to conform to the rail section. The ends of each branch are flattened to form a "nozzle" that is at the level of the top of the rail. The notches in the rail are preferably only about one inch long and do not need to be precisely machined. Most preferably, a "clip" similar to those used to hold down signal wires is provided to secure the tubing in place. The tubing passes through the hole in the clip and is most preferably soldered in place. The advantage of using clips in accordance with the present invention is that they are held by friction and require no machining or tooling for installation. Thus, the entire device can be relocated as the railroad maintenance dictates, when the track layout is changed, or the track itself is replaced.

DESCRIPTION OF THE INVENTION

Figure 1:
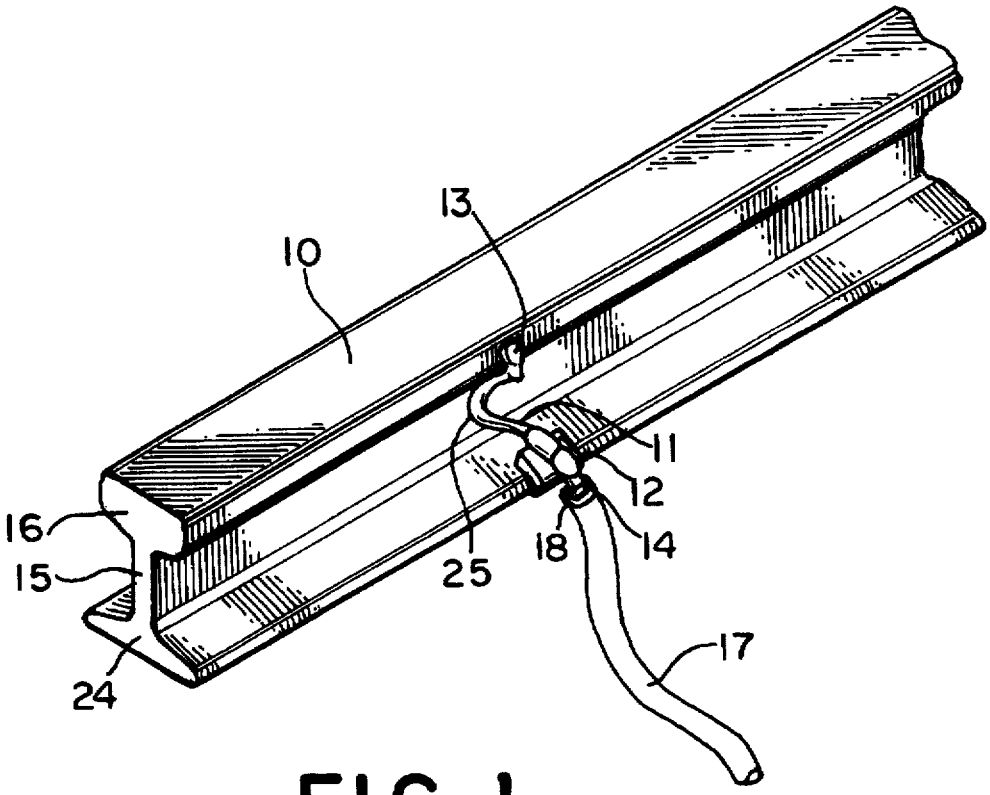
FIG. 1 is a broken away perspective view showing general location of the components of a preferred embodiment of the present invention.
Figure 6:
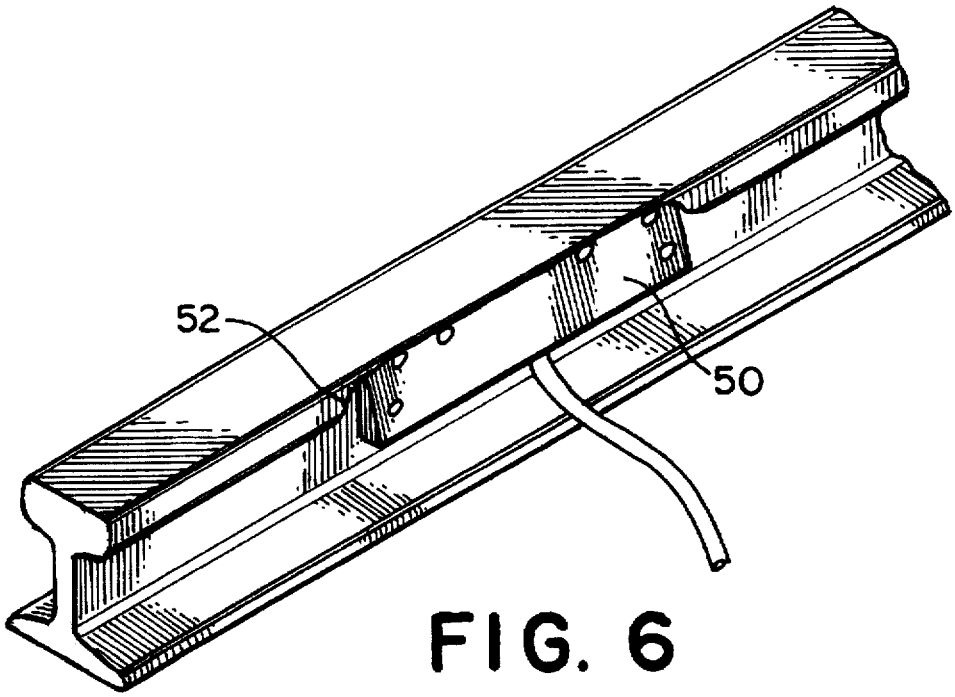
FIG. 6 PRIOR ART
FIG. 6 is a broken-away perspective view, similar to FIG. 1, illustrating a prior art flange oiler.

Referring now to FIG. 1 the overall arrangement of a preferred embodiment of the present invention is illustrated in a perspective view. A typical rail section 10 is shown, and those of skill in the art will understand that the surrounding environment, including the rail bed, rail ties and the like is not illustrated. Additionally, although flange oilers made in accordance with the present invention can be installed at curved rail sections, a straight section is illustrated for purposes of clarity. The rail 10 consists of a base 24, a web 15, and head 16. The tube 11 is appropriately attached to the tube retainer 12, and the tube retainer 12 is in turn attached to the base 24, as explained in further detail below. The tube 11 has whatever appropriate bends facilitate interchangeability between rail sections, ease of application, and ease of adjustment; an adjustment loop 25 is preferably formed by the bending of the tube as shown. While only one tube is shown, it should be understood that a plurality of tubes may be used on the same rail to provide for increased efficiency of lubricant application. Additionally, one or more tubes may be attached to the opposing rail at the same track location. For the sake of clarity this aspect of this embodiment of the present invention is not shown.

Figure 2:
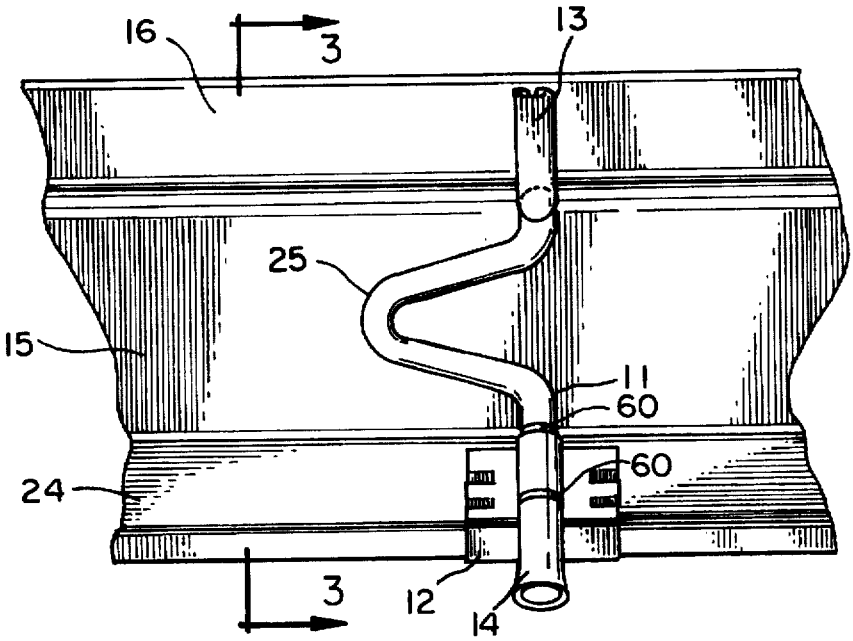
FIG. 2 is a side elevation view showing location of a single applicator tube.

FIG. 2 illustrates further details of the arrangement of the adjustment loop 25, the dispensing tip 13, and the lubricant inlet 14. The adjustment loop 25 lies against the rail web 15 where the tube is protected from a large majority of the hazards presented during service. The adjustment loop 25 is formed with a surplus of material in a fashion that allows the dimension between the dispensing tip 13 and the tube retainer 12 to be easily changed to adjust for various rail heights.

Figure 3:
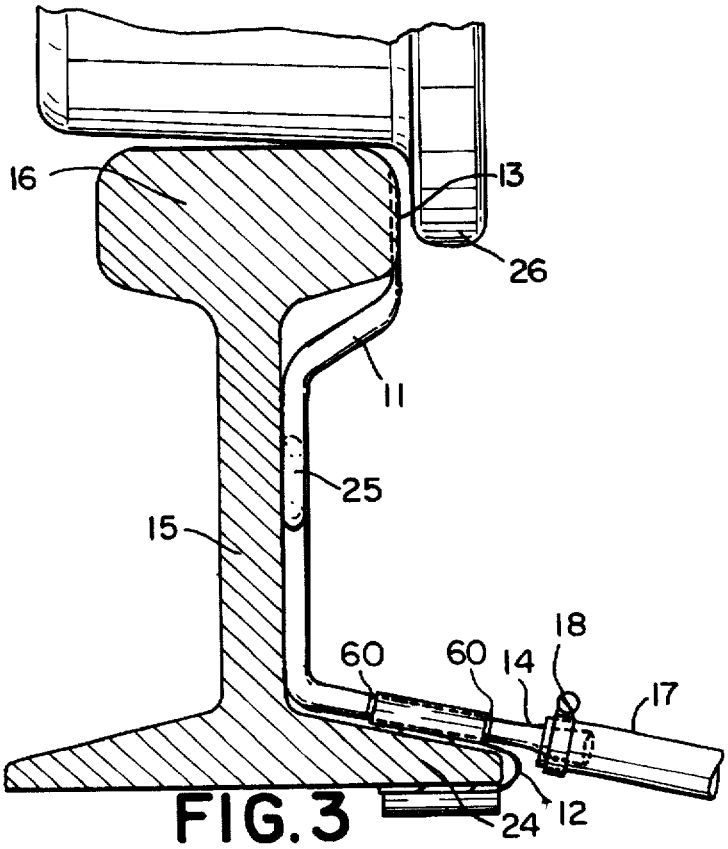
FIG. 3 is a rail cross section view taken along lines 3—3 in FIG. 2, showing location of wheel/rail contact patch and location of lubricant application.

Further details of the arrangement of the position of the tube 11, including the adjustment loop 25, on the rail web 15 are shown in FIG. 3, which also shows further details of the lubricant inlet 14. The lubricant inlet 14 is preferably flared to provide retention for a hose 17 and clamp 18 that prevents the hose 17 from accidentally disconnecting from the tube 11. The dispensing tip 13 is comprised of a flattened portion of the tube 11, thereby allowing the passing wheel flanges 26 of a railcar wheel to bypass the dispensing tip 13 without interference, as illustrated.

Figure 4:
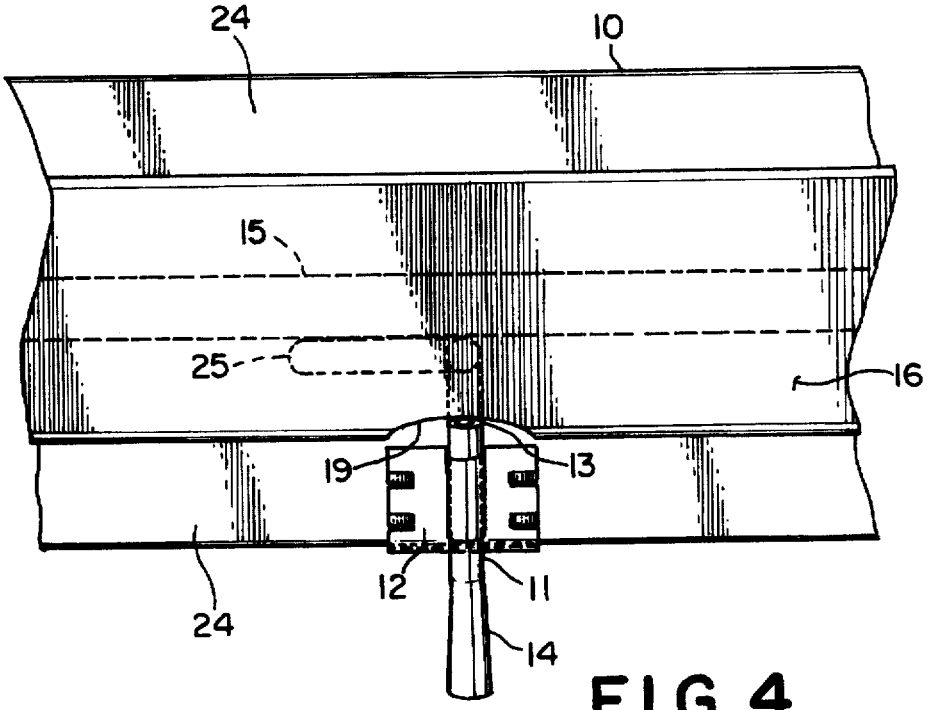
FIG. 4 is a top view showing gage corner relief used in certain embodiments of the present invention.

FIG. 4 shows a top view of the dispensing tip 13 and its alignment with the rail head 16. Also shown is the rail head relief 19 required when the invention is installed on rail with a worn rail section as frequently exists in curves. Those of skill in the art will appreciate that the rail head relief 19 need only provide an appropriate space for the dispensing tip 13 and need not be precisely machined to a specific dimension, tolerance or shape.

Figure 5B:
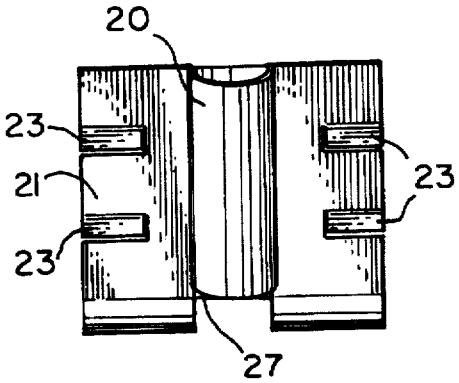
FIG. 5A–5C are, respectively, a perspective view, a top view, and a side view of a spring tube retainer made in accordance with the present invention.
Figure 5C:
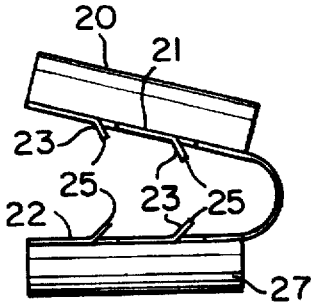
Figure 5A:
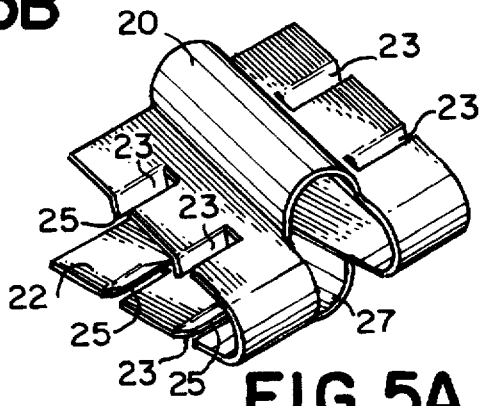

The details of the spring tube retainer 12 are shown in FIG. 5. The spring tube retainer 12 is basically a U-shaped piece of resilient material that has formed in its middle section a loop 20 for retention of the tube 11. The tube 11 is secured to the tube retainer by an appropriate means such as soldering 60, as depicted in FIGS. 2 and 3. For ease of fabrication, a similar loop 27 is formed into the bottom flange 22. The tube retainer also has formed into its top flange 21 and bottom flange 22 a plurality of barbs 23 which prevent the spring tube retainer from becoming loose on the rail base 24. These barbs have flat rail contacting surfaces 25 that engage the rail base 24 to prevent damage to the rail base. In use the spring tube retainer 12 is simply driven over the rail base 24. The frictional forces created by the resiliency of the material and the engagement of the barbs secure the retainer 12 in place without the need for additional fasteners. Moreover, the resilient frictional engagement is ideal for resisting vibration-induced loosening and thus securely retains the flange oiler while in service.

The present invention thus also discloses methods of applying lubricant to a rail by first forming a relief section in the rail, and then conforming a malleable tube section to the rail. The tip of the malleable tube is then positioned adjacent the top of the rail and affixed to the rail. Finally, the malleable tube is connected to a source of lubricant. Preferably, the step of conforming the malleable tube to the rail is accomplished by hand bending and forming. As discussed above, one aspect of the apparatus of the present invention is an improved retainer clip, and thus, it is preferred that the step of affixing the malleable tube to the rail comprises driving a retainer onto the rail.

Although the invention is shown and described with preferred embodiments, it is obvious that certain equivalent modifications will occur to other parties skilled in the art after reading and understanding the description. The invention includes all such equivalent modifications and is limited only by the scope of the following claims.

What is claimed:

1. An applicator for applying lubricant to an interface of a wheel of a railroad railcar and a rail, the rail having a top surface that intersects with a side surface, the applicator comprising:

a malleable tube having a distal end formed into a lubricant dispensing tip, the malleable tube being disposed against the side surface of the rail and underneath the top surface to protect the tube from damage, and the distal end being disposed in a relief section of the rail, the relief section being formed in a first portion of the side surface of said rail that is disposed at the intersection of said side surface and the top surface.

2. An applicator as set forth in claim 1, wherein the tube comprises a surplus of material formed into a loop, the loop being disposed on a second portion of the side surface of said rail, whereby the loop permits height adjustment of the lubricant dispensing tip.

3. An applicator as set forth in claim 1, further comprising a surplus of material in the dispensing tip to provide for adjustment to offset rail wear at the dispensing tip.

4. An applicator as set forth in claim 1, further comprising a flared lubricant inlet for securement of said malleable tube.

5. An applicator as set forth in claim 1, wherein the rail comprises a rail section and the applicator further comprises a plurality of malleable tubes adaptable to be affixed to the rail section.

6. An applicator as set forth in claim 1 wherein said malleable tube is comprised of copper.

7. An applicator as set forth in claim 1, further comprising a U-shaped spring tube retainer employing barbs on both a top and a bottom flange for securement to a base of the rail.

8. An applicator as set forth in claim 7 further comprising a plurality of tubes and a plurality of spring tube retainers.

9. An applicator as set forth in claim 7 wherein the tube is soldered to the spring tube retainer.

10. The apparatus of claim 1, wherein the relief section has a width wider than said malleable tube.

11. A method of applying lubricant to a railroad rail having a side surface that intersects with a top surface comprising the steps of:

forming a relief section in a portion of the side surface of said rail;

conforming a malleable tube having a dispensing tip to a portion of the side surface of the rail that is underneath the top surface of the rail;

positioning the dispensing tip within said relief section and adjacent the top surface of the rail so that the tip lies at approximately the intersection of the side portion and the top surface;

affixing the malleable tube to the rail; and connecting the malleable tube to a source of lubricant.

12. The method of claim 11, wherein the step of conforming the malleable tube comprises bending by hand.

13. The method of claim 11, wherein the step of affixing the malleable tube to the rail comprises driving a retainer onto the rail.

14. The method of claim 11, further comprising the step of flattening the malleable tube to form a dispensing tip.

* * * * *

UNITED STATES PATENT AND TRADEMARK OFFICE

CERTIFICATE OF CORRECTION

PATENT NO. : 5,722,509
DATED : March 3, 1998
INVENTOR(S) : Clinger

It is certified that error appears in the above-identified patent and that said Letters Patent is hereby corrected as shown below:

Title page, item [75], inventor's address should read --Hawthorn --.

Signed and Sealed this

Twenty-first Day of September, 1999

*Attest:*

Q. TODD DICKINSON

*Attesting Officer*

*Acting Commissioner of Patents and Trademarks*